United States Patent [19]

Tremmel

[11] Patent Number: 4,521,282

[45] Date of Patent: Jun. 4, 1985

[54] CYANIDE-FREE COPPER ELECTROLYTE AND PROCESS

[75] Inventor: Robert A. Tremmel, Woodhaven, Mich.

[73] Assignee: OMI International Corporation, Warren, Mich.

[21] Appl. No.: 627,715

[22] Filed: Jul. 11, 1984

[51] Int. Cl.[3] ..... C25D 3/38

[52] U.S. Cl. ..... 204/52 R

[58] Field of Search ..... 204/52 R, 44, 106, 123

[56] References Cited

U.S. PATENT DOCUMENTS

| | | | |
|---|---|---|---|
| 2,318,592 | 5/1943 | Cupery | 204/52 R X |
| 3,699,018 | 10/1972 | Carlson | 204/52 R |
| 4,038,161 | 7/1977 | Eckles et al. | 204/52 R |
| 4,462,874 | 7/1984 | Tomaszewski et al. | 204/52 R |
| 4,469,569 | 9/1984 | Tomaszewski et al. | 204/52 R |

*Primary Examiner*—G. L. Kaplan

*Attorney, Agent, or Firm*—Richard P. Mueller

[57] ABSTRACT

An improved aqueous cyanide-free electrolyte and process for depositing ductile, fine-grained adherent copper deposits on conductive substrates in which the electrolyte contains copper ions in an amount sufficient to electrodeposit copper, a complexing agent present in an amount sufficient to complex an effective amount of the copper ions present, a bath soluble and compatible buffering agent present in an amount sufficient to stabilize the pH of the electrolyte, hydroxyl and/or hydrogen ions present in an amount to provide a pH of about 6 to about 10.5, and sulfamic acid and the bath soluble and compatible salts thereof present in an amount effective to increase the anode efficiency during the electrodeposition of copper from said electrolyte. The electrolyte can optionally, but preferably further contain ammonium ions in combination with the sulfamic acid constituent to further enhance the anode efficiency and a wetting agent present in an amount up to about 2 g/l. The process for electrodepositing copper employing the foregoing electrolyte is performed employing a combination of insoluble anodes and soluble copper anodes adjusted to attain replenishment of the copper ions consumed by the oxidation and dissolving of the copper anode.

20 Claims, No Drawings

CYANIDE-FREE COPPER ELECTROLYTE AND PROCESS

BACKGROUND OF THE INVENTION

The present invention relates to an improved cyanide-free copper electrolyte and process, and more particularly to an improved electrolyte and process for electrodepositing copper in the form of an adherent, ductile, fine-grained copper plate on a variety of conductive substrates.

A variety of cyanide-free copper electrolytes have heretofore been used or proposed for use as replacements for the well-known and conventional commercially employed cyanide-containing counterparts. Typical of such processes are those described in U.S. Pat. Nos. 3,475,293; 3,706,634; 3,706,635; 3,833,486 and 3,928,147. A particularly satisfactory electrolyte composition and process for electrodepositing copper is described in U.S. patent application Ser. No. 551,135, filed Nov. 16, 1983 for "Cyanide-Free Copper Plating Process and Alloy Anode" (now U.S. Pat. No. 4,462,874), which is assigned to the same assignee as the present invention.

While the electrolytes and processes as described in the aforementioned United States patents have provided satisfactory copper electrodeposits under carefully controlled operating conditions, such electrolytes and processes have been found deficient from a commercial standpoint due to the wide disparity between the anode efficiency and cathode efficiency during electrodeposition. The foregoing problem is aggravated when high anode current densities are employed causing the anodes to become polarized. Under such conditions, a rapid depletion of the copper ion concentration in the electrolyte occurs accompanied by the formation of deleterious breakdown products in the electrolyte which detracts from optimum performance. A further problem encountered in connection with such prior art electrolytes is the coarse grain structure obtained under certain electroplating conditions particularly when heavy copper deposits are applied detracting from the application of a subsequent decorative copper or nickel overplate to provide a final article of the desired appearance.

The present invention overcomes the foregoing problems and disadvantages by providing an improved cyanide-free electrolyte in which the anode efficiency is substantially increased enabling electrodeposition at relatively higher average cathode current densities without encountering any tendency of the anodes to polarize while simultaneously enhancing the brightness of the copper electrodeposit and an improvement in grain refinement and uniformity of the copper deposit.

SUMMARY OF THE INVENTION

The benefits and advantages of the present invention are achieved in accordance with the composition aspects thereof by providing an aqueous cyanide-free electrolyte containing copper ions present in an amount sufficient to electrodeposit copper, a complexing agent present in an amount sufficient to complex an effective amount of the copper ions present, a bath soluble and compatible buffering agent present in an amount sufficient to stabilize the pH of the electrolyte, hydroxyl and/or hydrogen ions present in an amount to provide a pH of about 6 to about 10.5 and sulfamic acid as well as the bath soluble and compatible salts thereof present in an amount effective to increase the anode efficiency during the electrodeposition of copper from said electrolyte. Optionally, but preferably, the electrolyte further contains ammonium ions in combination with said sulfamic acid constituent in an amount up to about 1.5 gram per liter (g/l) to further enhance the anode efficiency and to attain fine-grained, adherent, ductile and uniform copper deposits. The sulfamic acid constituent is generally employed within a range of about 0.2 up to about 10 g/l with concentrations of about 0.5 to about 3 g/l being preferred for most conditions. The electrolyte may optionally further contain a bath soluble and compatible wetting agent present in an amount up to about 2 g/l.

In accordance with the process aspects of the present invention, the cyanide-free electrolyte as hereinabove described is employed for electrodepositing a fine-grained ductile, adherent copper deposit on conductive substrates including ferrous-base substrates such as steel, copper-base substrates such as copper, bronze and brass; and zinc-base substrates including zinc die castings. The substrate to be plated is immersed in the electrolyte as a cathode and a soluble copper anode in combination with an insoluble anode is employed to provide a copper anode to an insoluble anode surface area ratio generally of about 1:2 to about 4:1. The electrolyte is electrolyzed by passage of current between the cathode and anodes for a period of time sufficient to deposit the desired thickness of copper on the substrate. The electrolyte is operated at a temperature generally ranging from about 100° to about 170° F. with temperatures of about 120° to about 150° F. being preferred. The electrolyte can be operated at an average cathode current density of about 1 to about 80 amperes per square foot (ASF), depending upon bath compositions and other process variables as subsequently herein more fully described. Under certain conditions and with certain conductive substrates, it is desirable to effect an electrification of the substrate to be plated at a voltage of at least about 3 volts prior to immersion of the substrate into the electrolyte.

Additional benefits and advantages of the present invention will become apparent upon a reading of the Description of the Preferred Embodiments considered in conjunction with the specific examples provided.

DESCRIPTION OF THE PREFERRED EMBODIMENTS

A cyanide-free electrolyte prepared in accordance with the present invention contains as its essential constituents, copper ions, an organo-phosphonate complexing agent in an amount sufficient to complex an effective amount of the copper ions present, a stabilizing and buffering agent comprising a bath soluble and compatible carbonate, borate and/or acetate compound, as well as mixtures thereof, sulfamic acid and the bath soluble and compatible salts thereof present in an amount effective to increase the anode efficiency during the electrodeposition process, optionally, but preferably, ammonium ions to further increase anode efficiency, hydroxyl and/or hydrogen ions to provide a pH of about 6 to about 10.5, and optionally, a wetting agent.

The copper ions are introduced during makeup of the electrolyte by employing any one or mixtures of bath soluble and compatible copper salts such as sulfate, carbonates, oxides, hydroxides, and the like. Of the foregoing, copper sulfate in the form of a pentahydrate ($CuSO_4.5H_2O$) is preferred. The copper ions are present in the bath within the range of about 3 up to about 50 g/l, typically from around 5 to about 20 g/l. For example, when plating steel substrates, copper ion concentrations of about 15 up to about 50 g/l are employed to achieve a high rate of copper electrodeposition. In such instances in which the copper ion concentration is above about 20 g/l, it has been found by experimentation that electrified part entry into the bath is preferred to attain satisfactory adhesion. On the other hand, when plating zinc-base substrates such as zinc die castings, for example, copper ion concentrations of about 3.5 to about 10 g/l are preferred and in which instance the part must be electrified at the time of bath immersion to achieve an adherent deposit. During use of the electrolyte, a replenishment of the copper ions consumed during the electrodeposition operation as well as those removed by drag-out is achieved predominantly by the progressive dissolution of a copper anode employed in electrolyzing the bath. Because of this, it is important that the anode efficiency corresponds substantially to the cathode efficiency to avoid rapid depletion of copper ions from the electrolyte thereby avoiding the necessity of continuing analysis of the electrolyte and replenishment of copper by the separate addition of copper sulfate.

The complexing or chelating agent preferably comprises an organo-phosphorus ligand of an alkali metal and alkaline earth metal salt of which calcium is not suitable due to precipitation. Preferably, the complexing salt comprises an alkali metal such as sodium, potassium, lithium and mixtures thereof of which potassium constitutes the preferred metal. The complexing agent is present in the bath in consideration of the specific concentration of copper ions present.

The specific organo-phosphorus ligand suitable for use in accordance with the preferred practice of the present invention comprises a compound selected from the group consisting of 1-hydroxyethylidene-1, 1-diphosphonic acid (HEDP) by itself present in an amount of about 50 to about 500 g/l, a mixture of HEDP and aminotri—(methylene phosphonic acid) (ATMP) in which HEDP is present in an amount of at least about 50 percent by weight of the mixture, and a mixture of HEDP and ethylenediamine tetra (Methylene phosphonic acid) (EDTMP) in which HEDP is present in an amount of at least about 30 percent by weight of the mixture, as well as the bath soluble and compatible salts and partial salts thereof. When mixtures of HEDP and ATMP or HEDP and EDTMP are employed as the complexing agent instead of HEDP by itself, a reduction in the concentration of the complexing agent can be used due to the increased chelating capacity of the ATMP and EDTMP compounds in comparison to that of HEDP. Commercially available compounds of the foregoing types which can be satisfactorily employed in the practice of the present invention include Dequest 2010 (HEDP), Dequest 2000 (ATMP) and Dequest 2041 (EDTMP) available from Monsanto Company.

As previously indicated, the HEDP chelating agent can be employed at a concentration of about 50 g/l corresponding to a copper ion concentration of about 3 g/l up to a concentration of about 500 g/l corresponding to a copper ion concentration of about 50 g/l, with intermediate concentrations proportionately scaled in consideration of corresponding intermediate concentrations of copper ions. When a mixture of HEDP and ATMP is employed, preferably comprising about 70 percent HEDP and 30 percent by weight ATMP, it has been discovered that 14 g/l HEDP and 6 g/l ATMP are satisfactory at a copper ion content of 3 g/l while 225 g/l HEDP and 97 g/l ATMP are satisfactory at a copper ion bath concentration of 50 g/l. Corresponding adjustments in the concentrations of HEDP and ATMP are proportionately made when the copper ion concentration is intermediate of the 3 to 50 g/l limits to provide satisfactory chelation with a slight excess of chelating agent present in the bath. Similarly, when a mixture of HEDP and EDTMP is employed, preferably comprising about 50 percent by weight of each compound, it has been discovered that 9 g/l HEDP and 10 g/l EDTMP are satisfactory at a copper ion concentration of about 3 g/l while 145 g/l HEDP and 166 g/l EDTMP are satisfactory at a copper ion bath concentration of about 50 g/l with proportionate adjustments in the concentrations of these two constituents in consideration of intermediate copper ion concentrations. It will also be appreciated that alternative mixtures of chelating agents within the ranges specified will require proportionate adjustments in concentration of total chelating agent present in relation to copper ion concentration in consideration of the foregoing concentration relationships which can be readily calculated and confirmed by routine testing to provide optimum performance for any given conditions in further consideration of the specific examples hereinafter set forth.

A third desirable constituent of the copper electrolyte comprises a bath soluble and compatible stabilizing and buffering agent including carbonate compounds, borate compounds, acetate compounds as well as mixtures thereof. Preferably, sodium carbonate and potassium carbonate are employed to stabilize the electrolyte against pH fluctuations and to further serve as a carrier for contaminating metal ions introduced in the bath as a result of drag-in and dissolution of the parts in the electrolyte during the electrodeposition operation. The use of the aforementioned buffering agents has further been observed, depending upon the particular chelating agent used, to inhibit the formation of smutty copper deposits and eliminate dark copper deposits in the cathode low current density areas. Calcium ions are undesirable because of the tendency to form precipitates in the bath. The concentration of the buffer can broadly range from about 3 up to about 100 g/l calculated as the sodium salt, preferably about 10 to about 20 g/l. Concentrations of the buffering agent below the recommended minimum concentrations will result in pH fluctuations whereas concentrations above the maximum range specified do not appear to have any adverse effects on the operation of the electrolyte.

Since the buffering agent and complexing agent are subject to depletion by both decomposition and drag-out, a replenishment of these two chemicals to maintain the electrolyte within appropriate composition limits is necessary during commercial operation. This can conveniently be performed on an intermittent or continuous basis in response to an analysis of bath composition by adding the two constituents separately or in admixture in appropriate proportions.

A fourth constituent of the electrolyte comprises sulfamic acid as well as the bath soluble and compatible salts thereof including the alkali metal and ammonium salts as well as other compatible salts such as magnesium and copper, for example. The sulfamic acid constituent has been found not only to dramatically increase the anode efficiency during an electroplating operation but has been observed to further enhance the brightness of the copper electrodeposit and to serve as a grain refiner achieving uniformity of the copper deposit. The sulfamic acid constituent is employed in an amount which is effective to increase the anode efficiency and generally is used in amounts of from about 0.2 up to about 10 g/l calculated on a weight equivalent basis of sulfamic acid, and preferably within a range of about 0.5 to about 3 g/l. The use of sulfamic acid has been found to achieve satisfactory anode efficiencies when the electrolyte is employed at relatively low anode current densities such as, for example, current densities up to about 10 ASF. At higher anode current densities, it has been found desirable, and in some instances necessary, to further include ammonium ions in the electrolyte to further enhance the anode efficiency to provide a commercially acceptable process. It has been discovered, that the use of ammonium ions in relatively small concentrations of about 1 to about 2 g/l substantially improves anode efficiency and also reduces the tendency of the copper anodes employed to polarize at high anode current densities. However, the use of ammonium ions in the absence of sulfamic acid results in the copper deposit to become darkened and coarse-grained particularly in the high current density areas of the substrate being plated. When ammonium ions are employed in conjunction with the sulfamic acid constituent, concentrations of ammonium ions can range up to about 1.5 g/l. At concentrations above about 1.5 g/l, the detrimental effects of ammonium ions including coarse-grained and dark copper deposits in high current density areas occur and for this reason it is desirable to employ ammonium ions in concentrations of less than 1.5 g/l.

In accordance with the preferred practice of the present invention, sulfamic acid and ammonium ions are employed in conjunction with each other achieving thereby excellent anode efficiency, the elimination or substantial inhibition of a tendency of the anodes to become polarized at high current densities while at the same time achieving fine-grained adherent copper deposits particularly in the high current density areas. While ammonium ions can be employed in concentrations up to about 1.5 g/l depending upon the concentrations and types of other constituents present in the electrolyte and the operating conditions under which the electrolyte is employed, it is preferred to control the ammonium ion concentration within a range of about 0.2 up to about 0.5 g/l. The ammonium ions can be introduced in the form of any bath soluble and compatible salt such as ammonium hydroxide, ammonium carbonate, ammonium sulfate and preferably, ammonium bicarbonate. Because of the tendency of the ammonium ions to decompose into ammonia gas which escapes from the electrolyte, it is necessary to periodically replenish the electrolyte to maintain the ammonium ion concentration within the desired range. The sulfamic acid constituent is also depleted during operation of the bath and is periodically or continuously replenished to maintain proper operating concentrations. In an experimental operation, it was found that the addition of about 3 to 4 grams sulfamic acid per hour to an 800 gallon tank maintained proper operating conditions of the bath.

The electrolyte is adjusted to provide a pH of from about 6 up to about 10.5 with a pH of about 9 to about 10 being preferred. Typically an operating pH of about 9.8 has been found particularly satisfactory. The appropriate pH of the electrolyte can be maintained by adding an alkali metal hydroxide to the electrolyte to raise the pH of which potassium hydroxide is preferred. In order to reduce the pH within the desired range, a mineral acid or an alkali metal bicarbonate can be employed of which potassium bicarbonate constitutes a preferred material. When the operating pH decreases below the recommended level, it has been observed that the electrolyte tends to promote poor adhesion of the copper deposit on the substrate. On the other hand, at an operating pH above the recommended range, it has been observed in some instances, that the copper deposit becomes grainy and of a burnt characteristic. It has been found that at a pH of below about 7.5 down to about 6, satisfactory adhesion and deposit appearance can be obtained on copper and copper alloy substrates. However, when plating ferrous and zinc base substrates, a pH above about 7.5 to about 10.5 has been found to provide best results.

In addition to the foregoing constituents, the bath may optionally further contain a wetting agent or surfactant which is bath soluble and compatible with the other constituents therein. When such a surfactant is employed, it can be used in concentrations up to about 2 g/l with amounts of from about 0.01 to about 0.1 g/l being preferred. The particular concentration of the surfactant employed is dependent on the type of bath agitation used and the foaming characteristics of the surfactant to avoid excessive foam formation during electroplating. Typical surfactants suitable for use in the practice of the present invention include polyethylene oxides such as Carbowax 1000, alkyl sulfates such as 2-ethyl hexyl sulfate provided that the bath is carbon filtered to remove degradation products formed during operation, purfluro anionic wetting agents, and the like.

In the practice of the process of the present invention, the electrolyte can be operated at a temperature of from about 100° to about 170° F., preferably from about 120° to about 150° F. with temperatures of about 130° to about 140° F. being typical. The specific temperature employed will vary depending on bath composition such as will become apparent in the specific examples subsequently to be described. The bath can operate at an average cathode current density of from about 1 to about 80 ASF with an average cathode current density of about 10 to about 25 ASF being preferred.

The electrodeposition of the copper deposit can be performed in consideration of the other operating parameters of the bath within a time of as little as 1 minute to as long as several hours or even days with plating times of about 2 minutes to about 15 minutes being more usual for strike deposits. The specific time of electrodeposition will vary depending upon the thickness of the plate desired which will typically range from about 0.015 to about 5 mils.

The electroplating operation is performed by immersing the conductive substrate to be plated in the electrolyte and connecting the substrate to the cathode of a direct current source. It has been found that when the copper ion concentration is above about 20 g/l, it is advantageous, and usually necessary, to electrify the substrate prior to and during immersion in order to achieve good adherence of the copper plate on ferrous-base substrates. In the case of zinc-base substrates, it has been found essential at all copper ion bath concentrations to electrify the zinc-base substrate prior to and during entry into the bath at a minimum potential of about 3 volts to achieve satisfactory adhesion of the copper plate on the zinc-basis substrate.

A combination of anodes are employed for electrolyzing the bath and effecting the deposition of a copper plating on the cathode. The combination of anodes includes an insoluble anode and a copper anode of any of the types well-known in the art such as an oxygen-free high purity or electrolytic copper anode which is soluble and replenishes the copper ions consumed from the bath by electrodeposition and drag-out. It has been observed that when the concentration of copper ions falls below the recommended minimum concentration, a reduction in cathode efficiency occurs accompanied by burnt deposits. On the other hand, concentrations of copper ions above the recommended maximum range has been observed to adversely affect the adhesion of the copper deposit. While replenishment of copper ions can be effected by the addition of copper salts to the electrolyte, it is preferred in commercial practice to effect replenishment by dissolution of the copper anode at a rate substantially corresponding to the depletion rate of the copper ions by an appropriate adjustment of the copper anode surface relative to the insoluble anode surface and to provide an anode efficiency not disparate with the efficiency of the cathode. The specific copper anode surface area to insoluble anode surface area ratio can range from about 1:2 up to about 4:1 with a ratio of about 1:1 to about 2:1 being preferred. Moreover the ratio of the surface area of the cathode to the total anode surface area can range from about 1:1 up to about 1:6, preferably about 1:3 to about 1:5 and typically, about 1:4.

The insoluble anode employed in conjunction with the soluble copper anode can comprise a ferrite anode of the type described in U.S. patent application Ser. No. 455,353 filed Jan. 3, 1983 and now U.S. Pat. No. 4,469,569 for "Cyanide-Free Copper Plating Solution and Process" the teachings of which are incorporated herein by reference. Preferably, the insoluble anode comprises a nickel-iron alloy anode as more fully described in U.S. patent application Ser. No. 551,135 filed Nov. 16, 1983 the teachings of which are also incorporated herein by reference. In accordance with the preferred practice, the nickel-iron alloy anode contains from about 10 percent up to about 40 percent by weight iron with the balance essentially nickel and preferably from about 15 to about 30 percent iron. When a composite nickel-iron alloy anode is employed comprising a conductive core over the exterior of which a nickel-iron alloy layer or plate is applied, it is preferred to include sulfur in the alloy deposit to provide satisfactory operation and also to enhance the adhesion of the plate on the anode core. For this purpose, sulfur contents in amounts of about 0.005 up to about 0.06 percent by weight, and preferably about 0.01 to about 0.04 percent by weight are desirable.

It has been observed that agitation of the electrolyte during the electrodeposition step has a dramatic affect on deposit appearance and cathode efficiency. To insure uniform, fine-grained deposits over a broad average cathode current density range, vigorous agitation such as by air agitation is required. The lack of agitation has been found in some instances to produce dull, burned deposits at average cathode current densities of about 20 ASF. On the other hand, vigorous agitation produces brilliant deposits on parts of complex configuration at average cathode current densities up to 30 ASF and higher. While air agitation is preferred, it is also contemplated that mechanical agitation as well as movement of the workpieces themselves such as in barrel plating can be employed. Alternatively, the electrolyte can be pumped to create turbulence and agitation.

The term "anode efficiency" as herein employed is in accordance with the description provided in "Metal Finishing Guidebook and Directory", page 118 and is measured by calculating the theoretical weight loss of the anode based on 100 percent anode efficiency relative to the actual weight loss of the anode for a given quantum of current passage over a prescribed time period such as ampere minutes. It has been observed that in accordance with prior art cyanide-free electrolytes, the cathode efficiency generally ranges from about 90 to about 100 percent whereas the anode efficiency ranges from only about 50 to about 70 percent resulting in a relatively rapid depletion of copper ions from the electrolyte necessitating frequent and/or continuous replenishment. The improvement in the anode efficiency pursuant to the practice of the present invention is more fully demonstrated in the accompanying examples. It will be understood that the examples are provided for illustrative purposes and are not intended to be limiting of the scope of the present invention as herein described and as set forth in the subjoined claims.

EXAMPLE 1

An aqueous cyanide-free copper electrolyte was prepared containing about 7.8 g/l copper ions, about 83.5 g/l HEDP (Dequest 2010), about 20.2 g/l sodium carbonate with the pH adjusted to about 9.8.

One-half liter of the foregoing electrolyte was placed in a glass plating cell equipped with air agitation and provided with an insoluble nickel-iron alloy anode. The cell was placed in a hot water bath to maintain the operating temperature of the electrolyte at a temperature of about 138° F. to about 142° F. An electrolytic copper foil measuring two inches by six inches and about 0.005 to about 0.010 inch thick was weighed and placed into the plating cell such that a two inch by four inch surface area was immersed in the electrolyte. The anode was connected to the insoluble nickel-iron alloy anode and the entire cell connected to a typical direct current power source.

A brass cathode measuring 1.5 by 4 inches was placed in the plating cell and connected to the negative power source and plated at an average cathode current density of about 18 ASF with the average anode current density being about 17 ASF. The plating duration continued for 15 minutes. After the plating operation was terminated, the copper anode foil was removed, dried and weighed. The anode efficiency was measured by calculating the theoretical weight loss based on 100 anode efficiency and dividing the theoretical weight loss into the actual weight loss of the foil during electrolysis multiplied by 100. Accordingly, at an anode efficiency of 100 percent, 0.445 grams of copper will theoretically dissolve in 22.5 ampere-minutes (1.5 amperes for 15 minutes).

In accordance with the foregoing relationship, the anode efficiency was calculated to be 55.8 percent. Since the cathode efficiency in this plating test is generally about 95 percent or above, there is a large disparity between the anode efficiency and cathode efficiency which would cause a rapid depletion of copper ions in the electrolyte during commercial operation. The copper foil anode was also observed to be quite shiny indicating polarization had occurred during the electroplating process. The copper deposit on the cathode was of a uniformly dull appearance with low gloss.

EXAMPLE 2

A fresh one-half liter portion of the copper electrolyte prepared in accordance with Example 1 was placed in a glass plating cell to which the 0.5 g/l of ammonium ions were added in the form of ammonium hydroxide. A copper foil anode and a new brass cathode were employed for plating the brass test panel under the same conditions and procedure as described in Example 1. The anode efficiency was again calculated in accordance with Example 1 and the anode efficiency was observed to increase to 66.2 percent. The copper deposit on the brass cathode was observed to be slightly more grainy and duller on the high current density edges of the side of the cathode facing the anode. The anode appeared to be less polarized than that of Example 1.

EXAMPLE 3

A fresh one-half liter sample of the copper electrolyte prepared in accordance with Example 1 was placed in the glass plating cell to which 1.5 g/l of ammonium ions were added as ammonium hydroxide. A new copper foil anode and new brass cathode was employed which was plated under the same conditions as described in Example 1. A calculation of the anode efficiency revealed an increase to 88.5 percent but the copper deposit on the cathode was very dull and grainy in the high current density areas and this defect extended into many of the intermediate current density areas of the brass cathode. An observation of the anode indicated that it was not polarized.

EXAMPLE 4

The test described in Example 3 was repeated with the exception that 1 g/l of sulfamic acid was added to the electrolyte. The anode efficiency was calculated and increased to 95.3 percent while the copper deposit was of a uniform semi-dull appearance with a trace of graininess on the high current density edges facing the anode.

EXAMPLE 5

A fresh one-half liter sample of the copper electrolyte prepared in accordance with Example 1 was placed in a glass plating cell to which was added 0.5 g/l of ammonium ions as ammonium hydroxide and 0.5 g/l of sulfamic acid. A fresh brass cathode was plated employing a fresh copper anode foil in accordance with the procedure described in Example 1. A calculation of the anode efficiency indicated the efficiency was 88.5 percent while the copper deposit on the cathode was of a uniform and slightly more lustrous appearance than that obtained in accordance with Example 4. There was no graininess of the copper deposit in the high current density areas of the brass cathode.

EXAMPLE 6

A fresh one-half liter sample of the copper electrolyte prepared in accordance with Example 1 was placed in a glass plating cell to which 1 g/l of sulfamic acid was added and a new brass cathode and copper foil anode were placed in the electrolyte. The cathode was plated in accordance with the procedure as previously described in Example 1 and the anode efficiency calculated. The anode efficiency was determined to be 68.6 percent while the copper deposit was semi-bright over the entire cathode.

EXAMPLE 7

In order to determine the effectiveness of the use of sulfamic acid in electrolytes of higher copper ion and complexing concentrations, a one liter cyanide-free copper electrolyte was prepared containing 13.2 g/l copper ions, about 131 g/l of Dequest 2010 as the complexor, about 25.4 g/l of sodium carbonate and the pH was adjusted to about 9.3. Copper electrolytes at such higher copper ion concentrations have better anode efficiencies.

One-half liter of the above electrolyte was placed in a glass plating cell and a fresh brass test cathode was plated employing a fresh copper foil anode in accordance with the procedure described in Example 1. A calculation of the anode efficiency revealed an efficiency of 71.2 percent. The overall appearance of the copper electrodeposit on the cathode was uniformly dull and of low gloss.

EXAMPLE 8

A fresh one-half liter sample of the copper electrolyte prepared in accordance with Example 7 was placed in a glass plating cell to which was added 0.5 g/l of ammonium ions as ammonium hydroxide and 0.5 g/l of sulfamic acid. The plating test as described in Example 7 was repeated and the anode efficiency was calculated as 95.6 percent. The copper deposit on the brass cathode was of a uniform semi-bright appearance.

The foregoing examples clearly demonstrate that both sulfamic acid and ammonium ions increase anode efficiency and reduce or eliminate anode polarization. When sulfamic acid is employed in combination with ammonium ions, lower concentrations of these constituents are required to achieve desirable anode efficiencies while actually improving the copper deposit appearance.

While the replenishment of the complexing agent during operation of the electrolyte is usually done employing a neutralized alkali metal salt thereof to avoid a drastic reduction in the operating pH of the electrolyte, it is contemplated that the acid form of the complexor can be used for original or new bath makeup by first dissolving the acid form of the complexor in water followed by the addition of a base such as potassium hydroxide to increase the pH to a level above about 8. Thereafter, the buffering agent can be added to the preliminary solution in which a neutralization of the complexor has been accomplished in situ.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous cyanide-free electrolyte containing copper ions present in an amount effective to electrodeposit copper, a complexing agent present in an amount sufficient to complex an effective amount of the copper ions present, hydroxyl and/or hydrogen ions present in an amount to provide a pH of about 6 to about 10.5, and sulfamic acid and the bath soluble and compatible salts thereof present in an amount effective to increase the anode efficiency during the electrodeposition of copper from said electrolyte.

2. The electrolyte as defined in claim 1 in which said sulfamic acid and the bath soluble and compatible salts thereof are present in an amount of about 0.2 up to about 10 g/l.

3. The electrolyte as defined in claim 1 in which said sulfamic acid and the bath soluble and compatible salts thereof are present in an amount of about 0.5 to about 3 g/l.

4. The electrolyte as defined in claim 1 further including ammonium ions.

5. The electrolyte as defined in claim 4 in which said ammonium ions are present in an amount up to about 1.5 g/l.

6. The electrolyte as defined in claim 4 in which said ammonium ions are present in an amount of about 0.2 to about 0.5 g/l.

7. The electrolyte as defined in claim 1 in which said sulfamic acid and bath soluble salts thereof are present in an amount of about 0.2 to about 10 g/l, said electrolyte further including ammonium ions present in an amount up to about 1.5 g/l.

8. The electrolyte as defined in claim 1 in which said sulfamic acid and bath soluble and compatible salts thereof are present in an amount of about 0.5 to about 3 g/l, said electrolyte further containing ammonium ions present in an amount of about 0.2 to about 0.5 g/l.

9. The electrolyte as defined in claim 1 in which said hydroxyl ions are present in an amount to provide a pH of about 9 to about 10.

10. The electrolyte as defined in claim 1 further including a bath soluble and compatible buffering agent present in an amount sufficient to stabilize the pH of the electrolyte.

11. The electrolyte as defined in claim 1 further including a wetting agent present in an amount up to about 2 g/l.

12. A process for electrodepositing copper on a substrate including the steps of providing a plating cell containing an aqueous cyanide-free electrolyte comprising copper ions present in an amount effective to electrodeposit copper, a complexing agent present in an amount sufficient to complex an effective amount of copper ions present, and hydroxyl and/or hydrogen ions present in an amount to provide a pH of about 6 to about 10.5; immersing a copper anode and an insoluble anode and a substrate to be plated in the electrolyte, anodically electrifying the anodes and cathodically electrifying the substrate to effect the flow of current through the electrolyte between the anodes and substrate, and adding to the electrolyte sulfamic acid and the bath soluble and compatible salts thereof in an amount effective to increase the anode efficiency during the electrodeposition of copper from the electrolyte.

13. The process as defined in claim 12 in which the step of adding to the electrolyte sulfamic acid and the bath soluble and compatible salts thereof is controlled to provide a concentration of sulfamic acid and the bath soluble and compatible salts thereof in an amount of about 0.2 up to about 10 g/l.

14. The process as defined in claim 12 in which the step of adding sulfamic acid and the bath soluble and compatible salts thereof is controlled to provide a concentration of sulfamic acid and the bath soluble and compatible salts thereof in an amount of about 0.5 to about 3 g/l.

15. The process as defined in claim 12 including the further step of adding ammonium ions to the electrolyte in an amount effective to increase the anode efficiency during the electrodeposition of copper on the substrate.

16. The process as defined in claim 12 including the further step of adding ammonium ions to the electrolyte in an amount up to about 1.5 g/l.

17. The process as defined in claim 12 including the further step of adding ammonium ions to the electrolyte in an amount of about 0.2 to about 0.5 g/l.

18. The process as defined in claim 12 including the further step of controlling the copper anode surface area to insoluble anode surface area within a ratio of from about 1:2 up to about 4:1.

19. The process as defined in claim 12 including the further step of controlling the copper anode surface area to insoluble anode surface area within a ratio of from about 1:1 up to about 2:1.

20. The process as defined in claim 12 including the further step of controlling the surface area of the substrate to the total surface area of the anodes within a ratio of about 1:1 to about 1:6.

* * * * *